US007090106B2

(12) United States Patent
Holden

(10) Patent No.: US 7,090,106 B2
(45) Date of Patent: Aug. 15, 2006

(54) FRICTIONAL SURFACE APPARATUS FOR ONE HANDED DISPENSING OF PAPER SHEET SEGMENTS

(75) Inventor: William Holden, Durango, CO (US)

(73) Assignee: Holdenart, Inc., Durango, CO (US)

( * ) Notice: Subject to any disclaimer, the term of this patent is extended or adjusted under 35 U.S.C. 154(b) by 0 days.

(21) Appl. No.: 10/431,386

(22) Filed: May 8, 2003

(65) Prior Publication Data

US 2004/0222263 A1 Nov. 11, 2004

(51) Int. Cl.
*B26F 3/00* (2006.01)

(52) U.S. Cl. ..... 225/106; 225/25; 225/51; 225/82; 225/93; 83/649; 83/949

(58) Field of Classification Search ..... 225/106, 225/46, 69, 94, 51, 84, 6, 25, 93, 76, 82; 83/949, 649; 242/570, 554.2, 585, 590, 615, 242/615.3

See application file for complete search history.

(56) References Cited

U.S. PATENT DOCUMENTS

| | | | |
|---|---|---|---|
| 12,674 | A | 4/1855 | Duryea |
| 320,576 | A | 6/1885 | Myers |
| 393,629 | A | 11/1888 | Ehrlich |
| 404,321 | A | 5/1889 | Tivy et al. |
| 405,402 | A | 6/1889 | Ehrlich |
| 436,789 | A | 9/1890 | Jobes |
| 751,920 | A | 2/1904 | Jones |
| 842,959 | A | 2/1907 | Kaufman |
| 1,063,787 | A | 6/1913 | Evans |
| 1,243,569 | A | 10/1917 | Taylor |
| 1,325,300 | A | 12/1919 | Kundtson |
| 1,684,190 | A | 9/1928 | Moser |
| 2,156,502 | A | 5/1939 | Lawton |
| 2,181,207 | A | 11/1939 | Sanford |
| D155,897 | S | 11/1949 | Huntington |
| D179,846 | S | 3/1957 | Gralewicz |
| 3,067,963 | A | 12/1962 | Suggs |
| 4,556,160 | A | 12/1985 | Kurz et al. |
| D285,850 | S | 9/1986 | Waldron |
| 4,660,715 | A | 4/1987 | Anastos |
| 4,771,966 | A | 9/1988 | Anderson |
| 4,858,840 | A | 8/1989 | Kidman |
| 4,928,411 | A | 5/1990 | Danis et al. |
| 5,008,869 | A | 4/1991 | Dweck |
| D324,617 | S | 3/1992 | McCauley |
| 5,411,231 | A | 5/1995 | Buck |
| D374,585 | S | 10/1996 | Moon |
| 5,651,487 | A | 7/1997 | Hansen |
| D383,343 | S | 9/1997 | Goodman |

(Continued)

FOREIGN PATENT DOCUMENTS

| | | | |
|---|---|---|---|
| CA | 2212569 | A1 | 3/1999 |

(Continued)

*Primary Examiner*—Allan N. Shoap
*Assistant Examiner*—Phong Nguyen
(74) *Attorney, Agent, or Firm*—Bradford Kile; Kile Goekjian Reed & McManus

(57) ABSTRACT

An apparatus for one handed dispensing paper sheet segments from a roll of paper sheet segments connected end-to-end along transverse serration lines including a base member, a support connected to a base for holding a roll of paper sheet segments and a frictional gripping member connected to the base with a high friction outer surface. The frictional gripping member may also contain an arcuate inner surface for pivotal movement and contact with respect to a roll of paper sheet segments.

9 Claims, 7 Drawing Sheets

U.S. PATENT DOCUMENTS

| | | | | |
|---|---|---|---|---|
| D385,446 | S | 10/1997 | Keserica | |
| 5,727,721 | A | 3/1998 | Guido et al. | |
| D405,992 | S | 2/1999 | Lee et al. | |
| 6,007,019 | A | 12/1999 | Lynch | |
| 6,267,322 | B1 | 7/2001 | Harmathy | |
| 6,725,753 | B1 * | 4/2004 | Bell | 83/175 |
| 2002/0033406 | A1 * | 3/2002 | Holden | 225/96.5 |

FOREIGN PATENT DOCUMENTS

| | | | |
|---|---|---|---|
| EP | 0398851 | A2 | 11/1990 |
| GB | 2078633 | A | 1/1982 |
| GB | 2313105 | A | 5/1997 |

* cited by examiner

FRICTIONAL SURFACE APPARATUS FOR ONE HANDED DISPENSING OF PAPER SHEET SEGMENTS

CROSS-REFERENCE TO RELATED APPLICATION

This application relates to U.S. utility application Ser. No. 09/664,751 filed on Sep. 19, 2000 and entitled "SINGLE HAND, PAPER TOWEL SHEET DISPENSER" and to U.S. utility application Ser. No. 09/955,220 filed on Sep. 19, 2001 and also entitled "SINGLE HAND, PAPER TOWEL SHEET DISPENSER."

BACKGROUND OF THE INVENTION

This invention relates to a novel paper sheet dispenser. More specifically, the present invention is directed to a single hand, paper towel or tissue sheet dispenser that does not require a user to hold a roll of segmented, paper sheets with one hand in order to facilely tear off a desired number of the paper sheet segments.

Paper towels are routinely used in kitchens, restaurants and other settings where food is prepared and served. No matter where food is served, paper towel dispensers are often used to dispense paper towel sheets to clean up spills or to clean tables, floors and kitchen appliances. In addition, paper towel dispensers are often used in recreational settings, in addition to garages, auto or wood working shops and in other work or recreational areas where people need to absorb or wipe-up a spill, dry a surface or simply clean and/or dry their hands. Paper towels are usually sold in a roll having a width of approximately eleven inches or so and sheets of approximately six to fifteen inches in length connected end-to-end along serrated tear lines. The paper towel and bath tissue sheets are wound upon a paper core of approximately an inch and a half in diameter and sell with a retail diameter of the roll of about four to five inches in diameter.

Paper towels are often formed from one or two ply sheets of absorbent paper material. One brand of such paper towel product is known as BOUNTY, which is a registered trademark of the Proctor & Gamble Company. This brand comes in sheet lengths of a few inches or so to approximately eleven-by-eleven inches square. Another brand is referred to as BRAWNY which is a registered trademark of the Fort James Corporation and is conventionally sold in a roll of sheets eleven inches wide by thirteen point eight inches in length joined end-to-end along serration tear lines. In certain instances, sheets of paper towels may have other length and width dimensions. However, most disposable paper towel rolls have periodic transverse serrations to facilitate separation of discrete lengths or sheets.

In addition to paper towels, bathroom tissues are dispensed in segmented rolls which are unreeled and torn-off in desired numbers for use.

The above paper sheet products are often dispensed by using a simple U-shaped bracket holder. These holders are usually designed to be mounted upon a vertical wall surface or beneath a horizontal wood cabinet by wood screws. Each end of the U-shaped bracket is designed to hold one end of the paper sheet core or alternatively a rod can be axially extended through the center of the paper core and mounted at its ends between the U-shaped bracket or frame. At least one disadvantage of traditional paper sheet dispensers, including a simple U-shaped bracket holder, is that a person usually needs to use both hands to dispense the paper sheets.

This disadvantage represents an inconvenience and difficulty for some people, when one hand is holding a container, object of use, or is otherwise soiled or occupied. In such moments, the only option, in most instances, is for a person to find a place to set the container or other object of use so that both hands are free to tear off one or more sheets of paper product. If a user attempts to use inertia and jerk a few sheets from a roll, the roll often unreels. The user is then left with the task of rewinding unused numbers of paper product segments. In other instances, if a user attempts to use inertia to tear sheets from a roll, the entire roll may be pulled off the holder. The user must then pick up the roll rewind any useful portion and reposition the roll on the holder. Still further, if a roll of paper sheet segments is held with one hand, and a desired number ripped off with the other, the sheets of paper product may not tear at the serrated edges between individual sheets. This leaves uneven or jagged edges or strips of paper sheets hanging from the roll.

It would therefore be highly desirable to provide a means for dispensing different types of segmented paper, sheets that only requires a user to use a single hand to facilely tear off any number of paper sheets desired in a reliable and convenient manner. In addition, it would be desirable to provide a means for dispensing segmented paper sheets wherein a user can use a single hand to tear off segmented, paper sheets without touching or soiling other sheets of the roll of paper product with a user's hand.

Traditional paper sheet dispensers, including dispensers for paper towels, are often poorly designed or cheaply produced which means that a roll of paper sheets often falls off the dispenser when a person attempts to tear off a segment. Therefore, it would be desirable to provide a paper sheet dispenser that is rugged and reliable in design and function and will securely retain a roll of paper sheets during a dispensing procedure.

At least one paper sheet dispenser, known in the past, that is designed to operate with one hand, includes a pair of nesting plastic yokes that are pivotally connected to a base plate. In this design, a paper sheet roll is mounted on one of the yokes and trained over a top edge of the other yoke for tearing by a downward movement. In one embodiment this tearing operation is enhanced by use of tooth-shaped projections or a sharp blade fitted at an edge of the second yoke to assist in separating a desired number of sheets from a roll This design, although more convenient than most traditional roll dispensers, is composed of relatively light-weight plastic and a multipart mounting mechanism for the yokes. Accordingly, this design lacks ruggedness and does not take advantage of gravity to assist in a dispensing process. Moreover, the tear mechanism is simply an over a yoke bar design that is lacking user friendliness for a one handed operation.

In at least one further prior design, a roll of paper sheets was operably received within a trough with a slit along one edge of the bottom of the trough. A free end of the roll was trained through the slit and therefore operated as a dispensing unit. In this device there is nothing to brake rotation of the roll, except a user's second hand and therefore while this design will dispense paper sheet segments it exhibits many of the limitations of prior designs.

Traditional paper sheet dispensers do not provide an effective mechanism for limiting the unreeling of a roll of paper sheets except with the use of two hands. It would be desirable to enable a user to dispense one or more paper sheets using a single hand. Moreover, it would be useful to enable a user, relying on just one hand, to be able to reliably and conveniently dispense paper sheets from a dispenser mounted either against a wall or under a cabinet.

In the past paper sheet dispensers also did not have means for mounting the dispenser in different positions in a manner that provides for alternative left or right side loading of a roll of segmented, paper sheets on the dispenser and reliable single hand operation of the dispenser. Loading and operation of a paper sheet dispenser enables a user to use a single hand to tear off a desired number of sheets of paper product from either the left side or right side of the dispenser in a reliable and convenient manner. Therefore, it would be desirable to provide a means for dispensing segmented, paper sheets such that the dispensing unit can be mounted in different positions, such as against a generally vertical surface or in a generally horizontal mounting position such as under a cabinet, either in a kitchen or other work or recreational area, wherein the dispensing means is designed for reversible loading and operation. Such dispensing means would enable a user to reliably and conveniently mount a segmented, paper sheet, dispenser on either the right side or left side of a generally planar surface, for convenient dispensing of segmented, paper sheets. It would also be desirable to provide a means for dispensing segmented, paper sheets that can be mounted on a wood or plastic surface with screws or on a metallic surface by utilizing a permanent magnet and optionally wherein the base may be utilize to display personal or decorative pictures or designs or information for ready reference.

Another single hand, paper sheet dispenser in the prior art allows for bi-directional operation and is adaptively mountable as is the present invention. The main difference between this prior art and the subject invention is in the construction and components comprising the dispensing bale. In the prior art, the dispensing bale was comprised of an inner brake bar and a outer tear bar such that a roll of paper sheets positioned on the core holder were generally trained in an under/over path for braking rotation of the roll during a one handed dispensing operation. The subject invention does not require the use of an inner brake bar and an outer tear bar for one handed dispensing operation. To facilitate one handed dispensing the subject invention requires only a frictional gripping member with at least one passive segment and at least one frictional segment. Additionally, the frictional gripping member utilizes frictional force between a frictional segment of the member and the interior of a free end of a roll of paper sheets to prevent further unreeling of the roll of paper sheets when conducting a one handed dispensing operation while the passive segment(s) of the member contact the exterior of the coiled roll permitting selective rotation to allow controlled single hand dispensing.

It would further be desirable, in at least one embodiment of the invention, to provide a means for dispensing segmented paper sheets, including paper towels, wherein the dispensing means is composed of metal components or other construction which provides not only strength to the structure but also a useful gravity component that assists in braking action during removal of a number of paper segments from a roll by a user using a single hand during a dispensing operation.

In view of the limitations of traditional paper sheet dispensers, it would be therefore be desirable to provide a means for dispensing segmented paper sheets that enables a user to dispense segmented paper sheets with a single hand in a reliable and convenient manner, and which incorporated novel, desirable elements referred to above.

The difficulties and limitations suggested in the preceding are not intended to be exhaustive, but rather are among many which demonstrate that paper sheet dispensers appearing in the past will admit to worthwhile improvement.

OBJECTS OF THE INVENTION

It is a general object of the invention to provide a single hand dispenser of segmented paper sheets that will obviate or minimize problems and achieve desired advantages of the type previously described.

It is a general object of the invention to provide a single hand dispenser of segmented paper sheets wherein a desired number of one or more segmented paper sheets, may be facilely removed by one free hand without using a second hand that may be in use, soiled or otherwise occupied.

It is a specific object of the invention to provide a single hand dispenser of segmented paper sheets which utilizes a single frictional gripping member while concomitantly limiting a tendency of the roll of paper sheets to unreel during one handed dispensing operation.

It is another specific object of the invention to provide a frictional surface, single hand dispenser of segmented paper sheets for facilitating tearing of a desired amount of paper segments from a roll.

It is a general object of the invention to provide a single hand dispenser of segmented paper sheets wherein the dispenser may be mounted in a position for loading and dispensing paper sheets on either the right side or left side of a base plate, such that a user may use a single hand to operably dispense a desired number of sheet segments and is mounted on either the right side or the left side of a base plate.

It is another object of the invention to provide a single hand dispenser of segmented paper sheets wherein the dispenser may be operably mounted on vertical wood, plastic or metal surfaces or beneath horizontal surfaces such as cabinets.

It is another object of the invention to provide a single hand dispenser of segmented paper sheets wherein the dispenser continues to be highly effective in use, with only one hand, even as the size of the roll of segmented paper sheets decreases.

It is still another object of the invention to provide a single hand dispenser of segmented paper sheets wherein a roll of segmented paper sheets is automatically retained to prevent rotation as a sheet of paper is torn from the roll.

It is yet a further object of the invention to provide a single hand dispenser of segmented paper sheets wherein undesired unreeling of too many segmented paper sheets is avoided even though a selective number of a sheet segment is torn off with a single, one handed, stroke.

Still further, it is an object of the invention to provide a single hand, segmented, paper sheet dispensing system that during the sequence of tearing off a paper sheet will concomitantly leave a short segment of a next segmented, paper sheet to grasp for a subsequent dispensing operation.

BRIEF SUMMARY OF A PREFERRED EMBODIMENT OF THE INVENTION

A preferred embodiment of the invention, which is intended to accomplish at least some of the foregoing objects, includes a single hand, paper sheet dispenser comprising a base, a core holder operable to rotatably hold a roll of segmented, paper sheet segments connected together end-to-end along perforated tear lines, and a single hand paper sheet dispensing bale. The single hand dispensing bale includes a high friction gripping member. The frictional gripping member of the dispensing bale is positioned between an external surface of a roll of paper sheets and an interior surface of an unreeled free end of the roll. Accordingly, the frictional gripping member allows a number of paper sheets to be dispensed while operably securing the roll in position by having a frictional outer surface segment and at least one arcuate inner surface segment, such that individual sheets of a segment paper sheet roll can be facilely dispensed with one hand.

DRAWINGS

Other objects and advantages of the present invention will become apparent from the following detailed description of a preferred embodiment thereof taken in conjunction with the accompanying drawings, wherein.

Figure 9:
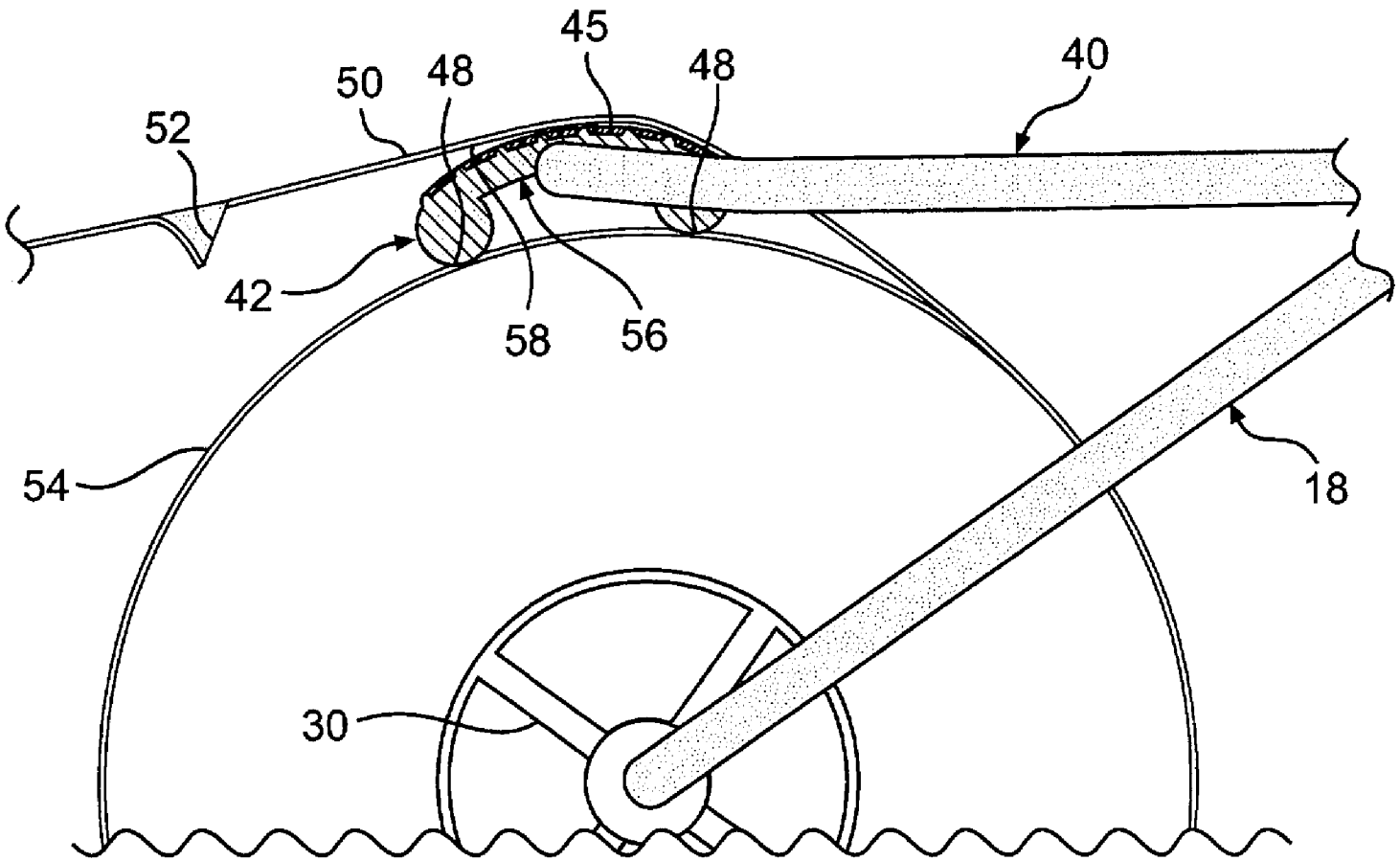
FIG. 9 is a partial end view of another embodiment of the subject invention disclosing a frictional gripping member that includes dual control segments and is pivotal with respect to a support arm.
Figure 10:
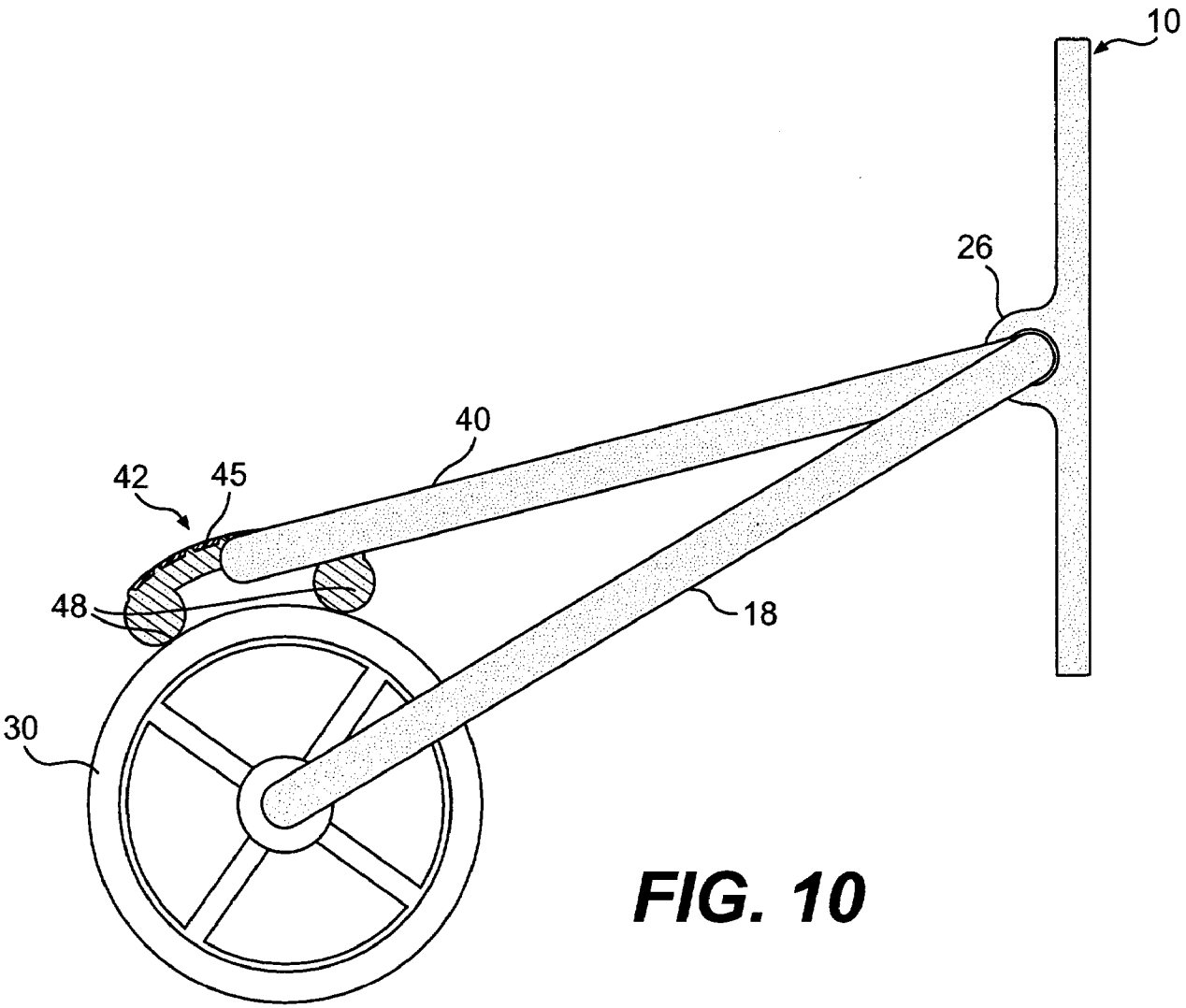
Figure 11:
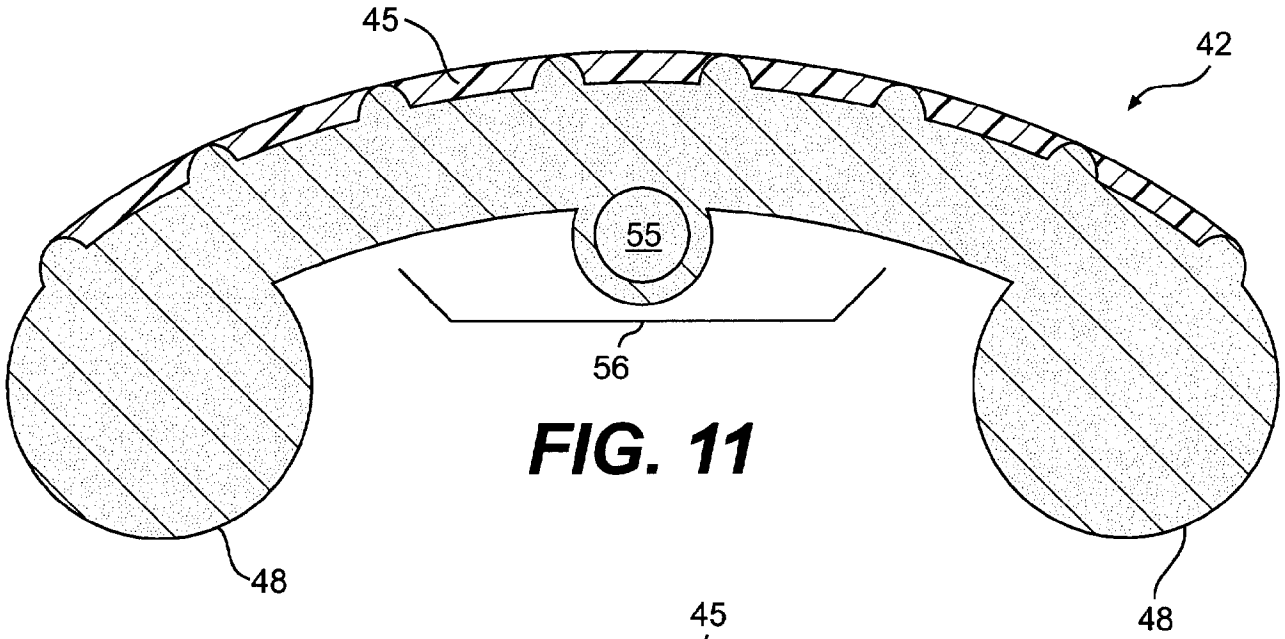
Figure 12:
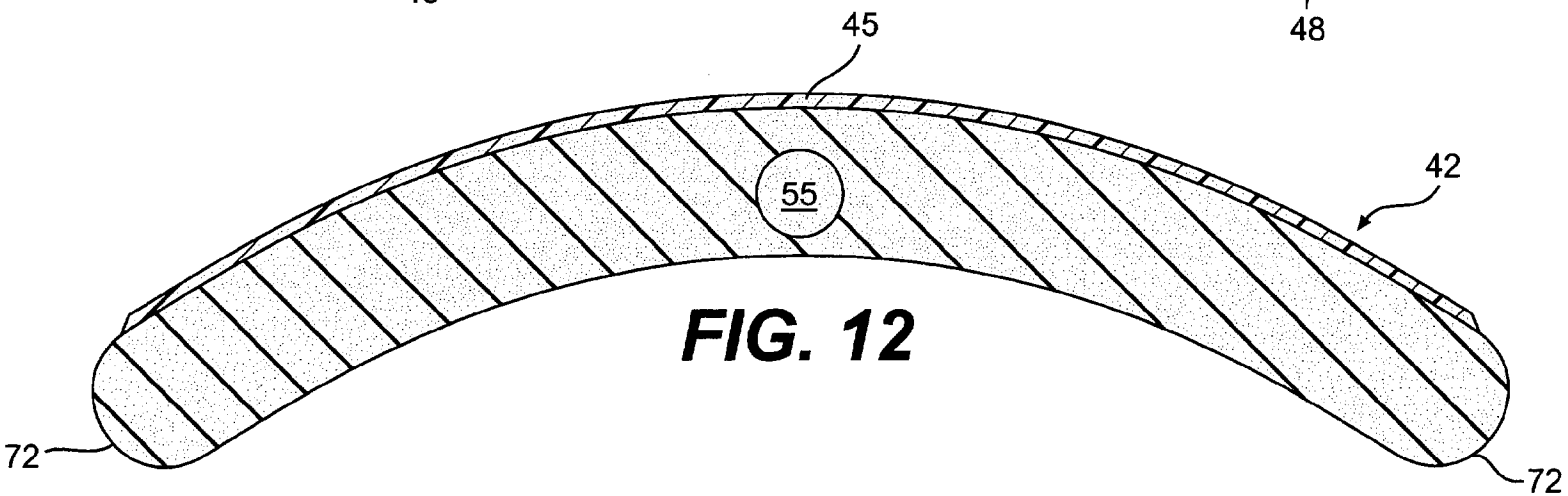

FIG. 10 discloses a side view of the embodiment of the invention depicted in FIG. 9 where a roll of paper sheets is almost at the end of the roll; and FIGS. 11 and 12 are detail side views of a frictional gripping member in accordance the embodiment of the invention disclosed in FIGS. 9 and 10.

DETAILED DESCRIPTION

Context of the Invention

The invention is directed to a novel paper sheet dispenser. The dispenser comprises a base for mounting to a support surface, a core holder operable for carrying a roll of segmented paper sheets, and a paper sheet-dispensing bale. The dispensing bale includes a frictional gripping member, which is pivotally connected to the base, containing a smooth arcuate, inner surface in contact with the paper sheets where they are wound into a roll and a frictional outer surface where paper sheets are unreeled for dispensing. The frictional surface of the frictional gripping member grips an unreeled portion of the roll, effectively preventing further unreeling and allows paper sheets to be dispensed with the use of only one hand.

The paper sheet dispenser is mountable on either a generally vertical surface or a generally horizontal surface. A desired number of paper sheets may be dispensed by pulling the unreeled sheets in a motion away from the frictional surface of the frictional gripping member. Once a desired number or number of sheets has been unreeled from the paper sheet roll, past the frictional gripping member, those sheets may be disengaged from the roll by pulling the dispensed sheets in a motion that engages a portion of the unreeled paper sheets with the frictional surface of the frictional gripping member. The frictional force between the paper sheets and the frictional surface allows a desired number of sheets to be facilely separated from the roll of paper sheets by a smooth downward and angled pulling stroke.

Frictional Gripping Member Dispensing

Referring again to the drawings, wherein like reference numerals indicate like parts, there will be seen preferred embodiments of the subject frictional surface apparatus for one handed dispensing invention.

Figure 1:
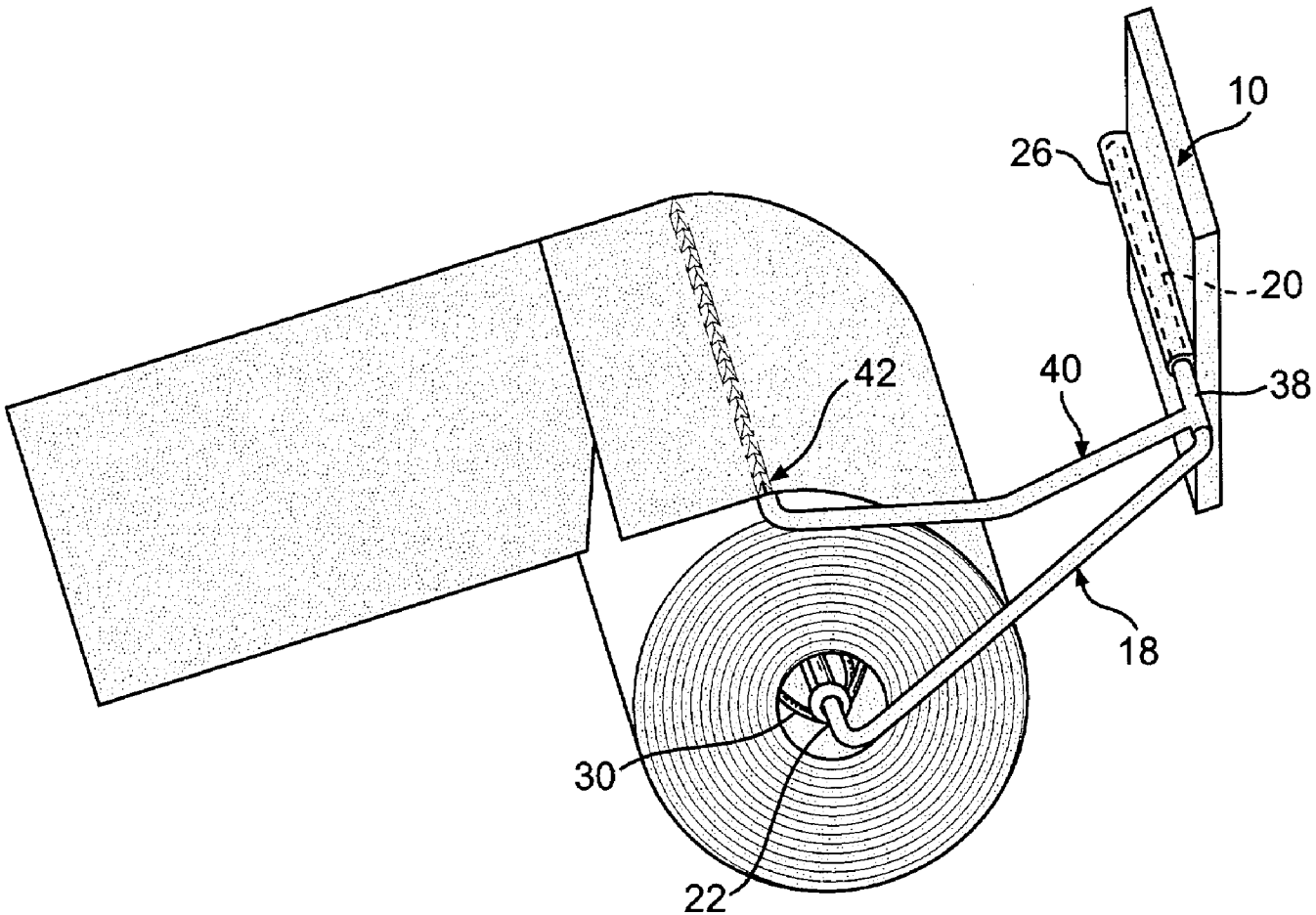
FIG. 1 is an axonometric or pictorial view of a single hand, paper sheet dispenser disclosing a preferred embodiment of the invention.

Referring to FIG. 1, one preferred embodiment of the invention is shown in accordance with the invention. In this embodiment of the invention, a base member 10 is formed from a generally rectangular member, which is operable to be mounted on a vertical or horizontal surface. Alternatively, the base may be round, oval, square or even irregular as desired.

The base 10 operably serves to carry a generally U-shaped wire core holder 18. The core holder 18 has a first rod 20 pivotally mounted on the base 10. This can be accomplished by different means, including an elongate sleeve segment 26 stamped out of the member 10 or two or more sleeve segments connected to the lower portion of the base (not shown). The core holder 18 has a second rod 22, extending parallel to the first, which serves to pivotally carry a core-carrying member 30. The core-carrying member 30 may be formed in a number of generally cylindrical shapes, including, but not limited to, a spiral-shaped wire cage. Another shape of the core-carrying member 30 can be a molded plastic unit that has voids throughout its length but is generally fashioned in the shape of a cylinder. Regardless of the material, or exact shape, the core carrying member 30 snuggly but releasably engages the interior surface of a paper core of a roll of paper sheets without relative rotation. The core carrying member 30, however, is pivoted upon, and free to rotate about, the second rod 22 of the core holder 18. The diameter of the core carrying member 30 can vary but is generally the size of a conventional paper core of a roll of paper sheets, such as paper towels or bathroom tissue.

In addition to the core holder 18 the base 10 operably carries, via a pivotal connection 38, a frictional free hand dispensing bale 40. The dispensing bale 40 is connected to the core holder 18 by a pivot sleeve 38.

The U-shaped core holder 18 and dispensing bale 40 are preferably composed of a heavy gauge solid wire construction so that they are rugged. Other materials and shapes such as tubular plastic bars are envisioned and may be used, however, a heavy wire composed of painted or plated low-grade steel, or even stainless steel, is presently preferred.

The dispensing bale 40 is a generally U-shaped member fashioned with a frictional gripping member 42. The frictional gripping member 42 is operable to extend transversely across and contact an exterior surface of a roll of paper sheets, mounted upon the core holder 18, while operably extending transversely across the direction of unreeling of a roll of paper sheets. The frictional gripping member 42 is operably positioned between the exterior surface of a roll of paper sheets and the unreeling path of the roll, providing a path of unreeling for the roll and a frictional surface to assist in dispensing.

A roll of paper sheets is usually formed with transverse serrated or score lines across the sheets to facilitate separation. Accordingly, if an amount of paper sheet are drawn out, generally horizontally, or unreeled to a desired amount, by a user's single hand, until a score line is an inch or two beyond the frictional gripping member 42, downward motion by the user will cause friction between the frictional gripping member 42 and the paper sheets. In addition, downward pivoting motion of the bale 40 and the core holder 18 serves to pin the side of the roll of paper sheet against a vertical wall carrying the base 10.

The frictional gripping member 42 is, as described above, positioned above an exterior surface of a roll of paper sheets. The frictional gripping member 42 functions to contact the exterior surface of a roll, assisting in preventing unwanted unreeling of a roll, while concomitantly providing a frictional surface to allow for single handed dispensing operation in certain embodiments of the invention.

In alternative embodiments, the frictional gripping member 42 is free standing and suspended, functioning primarily to provide a frictional surface for single handed dispensing operation. Further, in this embodiment, the frictional gripping member 42 does not require a passive segment, and the complete outer surface of the member may be composed of a frictional pattern and/or material.

In yet another embodiment, referring to FIG. 1, the invention is designed to be bidirectional in that a user might want to install the segmented, paper sheet dispenser of the present invention so that the core carrying member 18 can be loaded from either the right side or left side of the dispenser. To make the dispenser bidirectional, the frictional gripping member 42 is reversed while the dispensing bale 40 is rotated to the other side of the base plate 10. Then the user reinserts the core carrying unit 18 in the other end of the base plate 10, such that the mounting arm 20 is inserted through the elongate sleeve segment 26 from the opposite direction.

Figure 2:
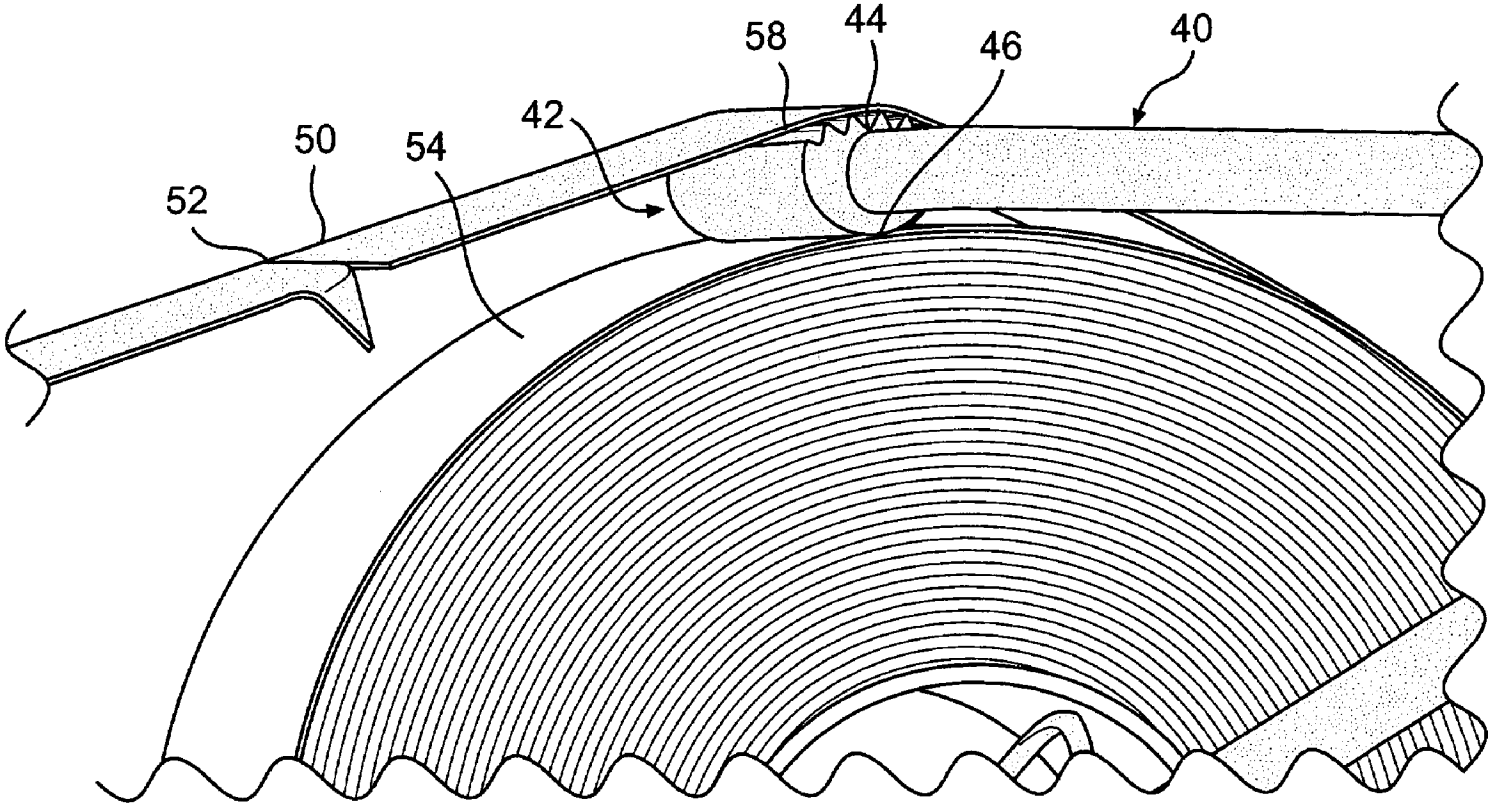
FIG. 2 is a partial end view of the paper sheet dispenser depicted in FIG. 1 and disclosing a high friction gripping surface to provide a facile tear of a selected number of sheets of paper from a roll.

FIG. 2 depicts a partial end view of the dispensing bale 40, where a frictional gripping member 42 is positioned between the free end 50 of a roll of paper sheets and the exterior of the coiled roll 54. Gently pulling on the free end 50 of a roll of paper sheets away from the frictional gripping member 42 unreels a number of sheets. The frictional gripping member 42 is a generally circular bar, in cross section, containing an upper frictional segment 44 and a lower passive segment 46. The passive segment 46 of the frictional gripping member 42 has a smooth, generally arcuate surface at a point of contact with the exterior surface 54 of the coiled roll, allowing unreeling of paper sheets while concomitantly preserving the position of the roll of paper sheets on the core carrying unit 18 in a pinning engagement. After a desired number is unreeled and a serrated line 52 is extended an inch or so beyond the frictional gripping member 42, a motion downward will create friction between the inner surface 58 of free end 50 of the roll and a frictional segment 44 of the frictional gripping member 42 which will create a clean, one handed tear, along serration line 52 of the roll of sheets and brake further rotation of the roll of sheets.

Generally, FIGS. 3 through 8 depict various embodiments of a frictional gripping member 42 in accordance with one preferred embodiment as described above and shown in FIG. 2. Moreover, FIGS. 3 through 8 are intended to exemplify three characteristics: 1) general shape of the frictional gripping member 42; 2) frictional segment 44 surface patterns; and 3) frictional segment 44 surface materials. Various combinations of these characteristics, as exemplified in the FIGURES, are envisioned as preferred embodiments, although not all combinations are shown.

Figure 3:
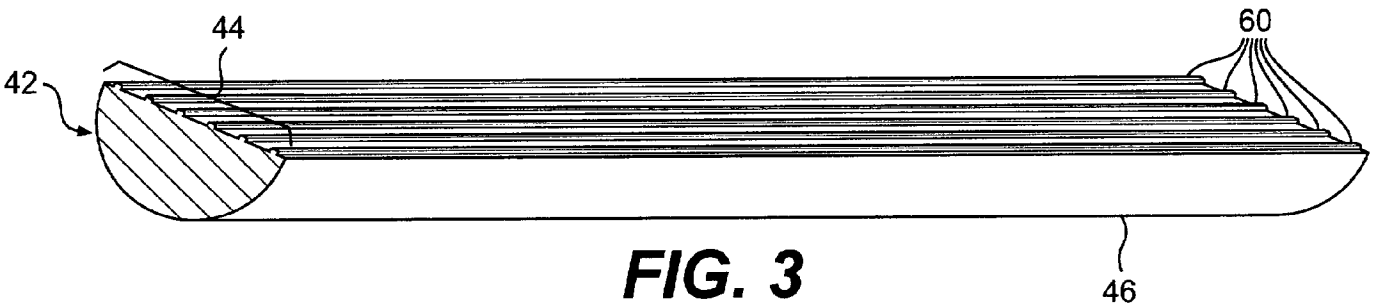
FIG. 3 is an axonometric view of one preferred form of a frictional gripping member in accordance with the subject invention.

FIG. 3 depicts a frictional gripping member 42 where the frictional segment 44 is a generally planar section with mutually parallel ridges 60 extending longitudinally along the outer surface of the frictional gripping member 42. The passive segment 46 is a generally arcuate smooth surface having a lower coefficient of friction than the upper surface, i.e., frictional segment 44. In addition, FIG. 3 demonstrates one particular embodiment of the shape of the frictional gripping member 42, having a planar frictional segment 44 which can have various frictional surfaces, including, but not limited to, those patterns and materials shown in FIGS. 4–8, and an arcuate passive segment 46.

Figure 4:
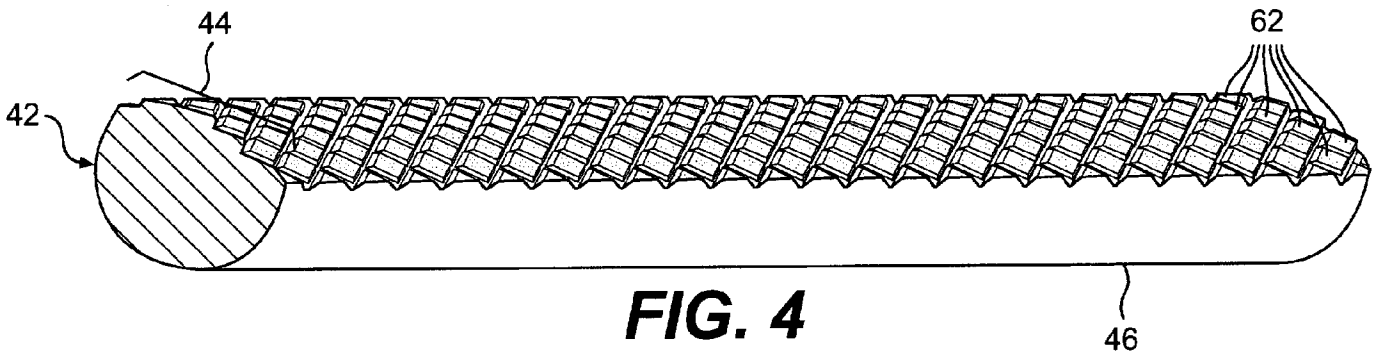
FIG. 4 is a view similar to FIG. 3 but disclosing another frictional gripping member in accordance with the invention.

FIG. 4 depicts a frictional gripping member 42 where the frictional segment 44 is a generally crowned section with a diagonal hatch or cross pattern of recesses 62 within the outer surface of said frictional gripping member. The frictional segment 44 has a larger arcuate radius than the passive segment 46. Additionally, FIG. 4 demonstrates another embodiment of the shape of the frictional gripping member 42, having two arcuate segments with differing radii. As similarly described in FIG. 3, this particular shape of a frictional gripping member 42 can facilitate various combinations of frictional surface patterns and materials, as depicted throughout FIGS. 3 through 8.

Figure 5:
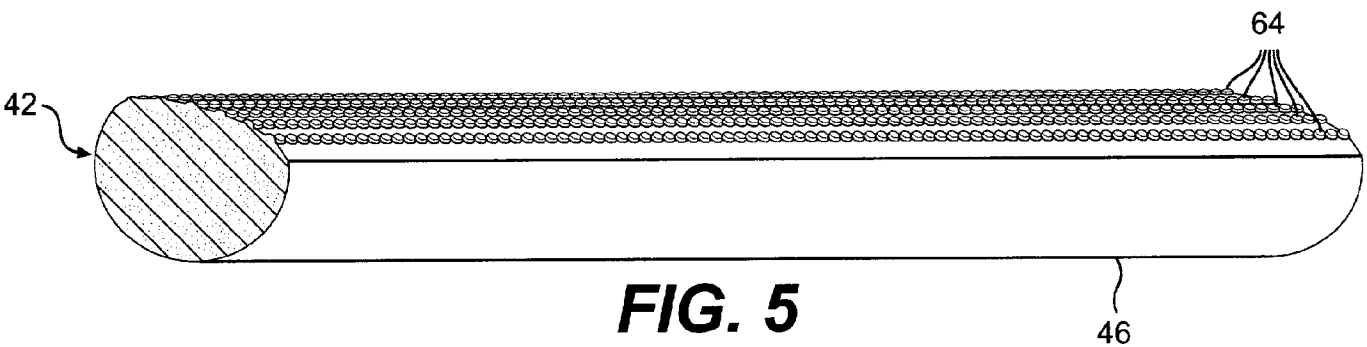
FIG. 5 is another view similar to FIG. 3 disclosing yet another preferred form of the invention frictional gripping member.

FIG. 5 depicts a frictional gripping member 42 where the frictional segment 44 is a generally crowned section with mutually parallel rows of raised protrusions 64 extending from the outer surface of the frictional gripping member 42. The frictional segment 44 has a larger arcuate radius than the passive segment 46.

Figure 6:
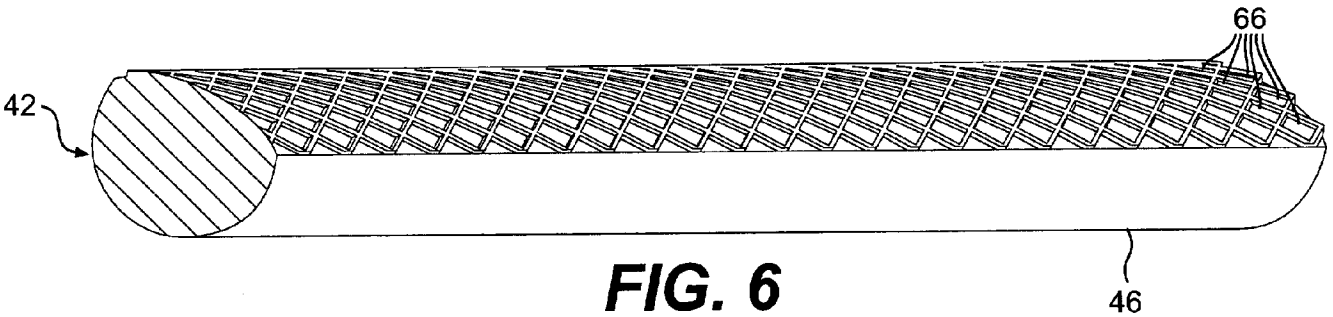
FIGS. 6 through 8 are views similar to FIGS. 3 through 5 showing various preferred forms of frictional gripping members in accordance with the invention.

FIG. 6 depicts a frictional gripping member 42 where the frictional segment 44 is a generally crowned section with a diagonal hatch or cross pattern of ridges 66 along the outer surface of said frictional gripping member 42. The frictional segment 44 has a larger arcuate radius than the passive segment 46.

Figure 7:
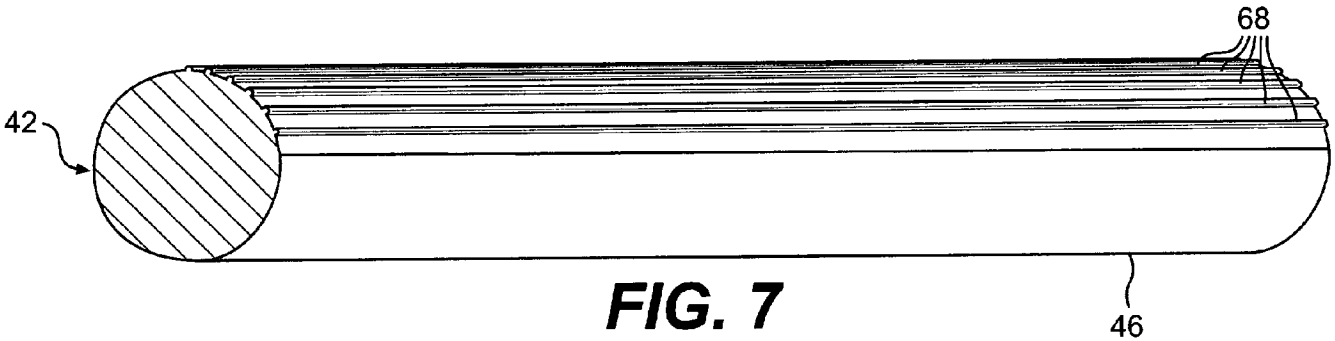

FIG. 7 depicts a frictional gripping member 42 where the frictional segment 44 is a generally circular section with mutually parallel ridges 68 extending longitudinally along the outer surface of the frictional gripping member 42. The frictional segment 44 has an arcuate radius that is approximately the same as that of the passive segment 46. Additionally, FIG. 7 demonstrates yet another embodiment of the shape of the frictional gripping member 42, being generally round with a frictional segment 44 and a passive segment 46. As similarly described in FIGS. 3 and 4, this particular shape of a frictional gripping member 42 can facilitate various combinations of frictional surface patterns and materials, as depicted throughout FIGS. 3 through 8.

Figure 8:
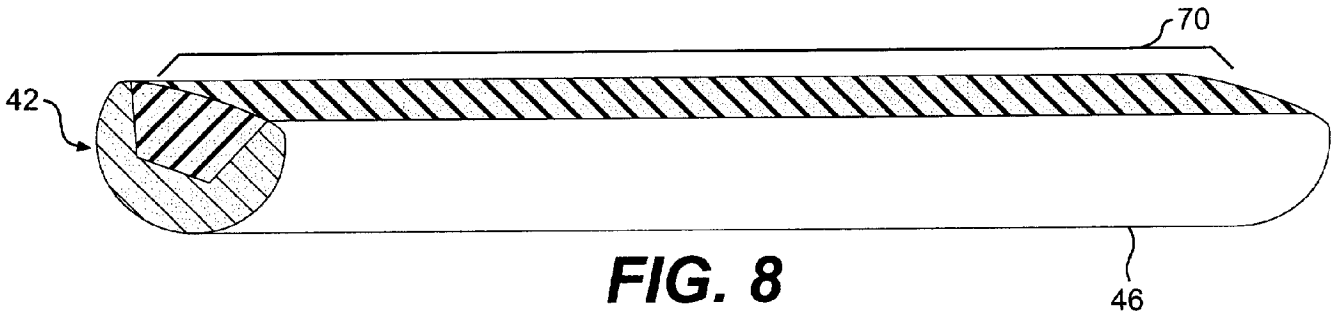

FIG. 8 depicts a frictional gripping member 42 where the frictional segment 44 is a generally crowned section with an elastomeric coating 70 on the outer surface of the frictional gripping member 42. The elastomeric coating 70 creates friction due to the material characteristics, and does not have to be textured. The frictional segment 44 has a larger arcuate radius than the passive segment 46.

Other embodiments of a frictional gripping member, not shown in the FIGURES or described above, include a textured surface of the frictional segment 44 made of an elastomeric coating, providing enhanced gripping characteristics for the frictional segment 44. Additionally, with reference to the free standing, suspended frictional gripping member embodiments referred to in the description of FIG.

1, the frictional gripping member 42 does not require a passive segment as depicted in FIGS. 3 through 8, since the member 42 does not contact the exterior of the wound roll. In one particular embodiment the entire outer surface of the frictional gripping member 42 may be composed of a frictional surface, i.e., a frictional pattern and/or frictional material, allowing a user to tear away segmented paper sheets with any motion creating friction between an unreeled portion of the roll of sheets and the frictional gripping member 42.

Turning now to FIGS. 9 and 10, another preferred embodiment of the subject invention is shown. In this particular embodiment the frictional gripping member 42 is a wider generally arc-shaped structure, containing two passive segments 48 and a frictional segment 45. Referring to FIG. 9 and as previously described in another embodiment, the frictional gripping member 42 is operably positioned between the exterior surface 54 of a coiled roll of paper sheets and the free end 50 of the roll of paper sheets, providing a path of unreeling for the free end 50 of a roll of paper sheets and a frictional surface 45 to assist in dispensing. In this embodiment the frictional gripping member 42 is pivotally connected along the arcuate bridge 56 to the dispensing bale 40. The pivotal connection of the frictional gripping member 42 allows the member to swivel. Accordingly, the swivel action of the frictional gripping member 42 allows the dispenser to be reversible. The concave characteristic of the frictional gripping member 42 against the roll of paper sheets adjusts to follow the contour of the roll as the roll decreases in size.

Referring to the two passive segments 48, each contains a smooth, generally round surface that contacts the exterior surface 54 of a coiled roll of paper sheets, allowing unreeling of paper sheets while concomitantly preserving the position of the roll of paper sheets on the core carrying unit 18 in a pinning engagement. The passive segments 48 are mutually parallel rods connected by an arcuate bridge 56 containing the frictional segment 45.

FIGS. 11 and 12 depict embodiments of a frictional gripping member 42 in accordance with the preferred embodiment described above and shown in FIGS. 9 and 10.

FIG. 11 depicts a cross sectional view of one embodiment of frictional gripping member 42, having two passive segments 48 that are mutually parallel rods connected by an arcuate bridge 56. The arcuate bridge 56 contains a frictional segment 45 with a friction pattern and a larger arcuate radius than the passive segments 48. The arcuate bridge 56 also contains a swivel hole 55 in its center, allowing the frictional gripping member 42 to be pivotally connected to the dispensing bale when a rod is placed and secured into the swivel hole 55.

FIG. 12 depicts a cross sectional view of yet another embodiment of frictional gripping member 42 where the member is an arcuate bar. The smooth ends 72 extend the length of the frictional gripping member 42 and are mutually parallel. The smooth ends 72 are passive segments of the frictional gripping member 42. The frictional gripping member 42 contains a frictional segment 45 made of a high friction material and/or a textured surface along its convex exterior. The arcuate bar 42 also contains a swivel hole 55 in its center, allowing the frictional gripping member 42 to be pivotally connected to the dispensing bale when a rod is placed and secured into the swivel hole 55.

MAJOR ADVANTAGES OF THE INVENTION

Without attempting to identify all of the advantages specifically identified and inherently disclosed in the foregoing specification those of skill in the art will recognize several advantages of the subject invention. Specifically, a single frictional gripping member, having an inner arcuate surface and an outer high friction surface, enables facile one handed tearing of sheet segments from a roll.

The single frictional gripping member does not require separative threading of the paper sheets through a dispensing bale, and the high friction outer surface enables facile tearing of a desired number of sheet segments.

The multiple inner contact embodiment of the frictional gripping member conforms well to the decreasing size of a dispensing roll and facilitates full contact with an outer surface of the roll. Alternatively, in other embodiments of the subject invention, the frictional gripping member is suspended so that it does not contact the outer surface of a roll of paper sheets, and primarily functions to provide a frictional surface, allowing for single-handed dispensing operation.

The varied patterns and materials used to create a high friction outer surface for the frictional gripping member provides sufficient with respect to unreeling of a roll of paper sheet segments to provide facile tearing of a desired number of sheets.

Other embodiments of a frictional gripping member, not shown in FIGS. 11 and 12 or described above, include a frictional segment 45 made of an elastomeric coating and containing some friction pattern, such as those exemplified in FIGS. 3 through 7, providing enhanced gripping characteristics.

In describing the invention, reference has been made to preferred embodiments and illustrative advantages of the invention. Those skilled in the art, however, and familiar with the instant disclosure of the invention, may recognize additions, deletions, modifications, substitutions, and other changes which will fall within the purview of the subject invention.

What is claimed is:

1. An apparatus for one handed dispensing paper sheet segments, or a paper sheet segment, from a roll of paper sheet segments connected end-to-end along transverse serration lines comprising:

a base operable for attachment to a support surface;

a support connected to said base for holding a roll of paper sheet segments connected end-to-end with transverse serration lines and permitting unreeling of paper sheet segments from the roll; and a frictional gripping member operably connected to said base, said frictional gripping member extending transversely across the roll of paper sheet segments and having, in cross section, at least one arcuate inner shape and an outer surface having an enhanced friction surface wherein unreeling a desired number of paper sheet segments may be achieved with one hand and tearing of the desired number of sheet segments along a transverse serration positioned just downstream of said frictional gripping member can be facilely achieved by pulling with one hand, wherein the outer enhanced friction surface of said frictional gripping member functions to grip a surface of the paper sheet segments, and wherein said at least one arcuate inner shape comprises:

a pair of mutually parallel rods longitudinally connected with an arcuate bridge, each of said rods having a generally rounded surface physically contacting an outer surface of the roll of paper sheet segments.

2. An apparatus for one handed dispensing paper sheet segments, or a paper sheet segment, from a roll of paper sheet segments connected end-to-end along transverse serration lines as defined in claim 1 wherein:

said enhanced friction surface extends along said connecting bridge.

3. An apparatus for one handed dispensing paper sheet segments, or a paper sheet segment, from a roll of paper sheet segments connected end-to-end along transverse serration lines as defined in claim 2 wherein said enhanced friction surface comprises:

a textured surface extending along said bridge member.

4. An apparatus for one handed dispensing paper sheet segments, or a paper sheet segment, from a roll of paper sheet segments connected end-to-end along transverse serration lines as defined in claim 3 wherein said textured surface comprises:

a plurality of mutually parallel ridges extending along said bridge member.

5. An apparatus for one handed dispensing paper sheet segments, or a paper sheet segment, from a roll of paper sheet segments connected end-to-end along transverse serration lines as defined in claim 3 wherein said textured surface comprises:

a cross pattern of ridges within the outer surface of said bridge member.

6. An apparatus for one banded dispensing paper sheet segments, or a paper sheet segment, from a roll of paper sheet segments connected end-to-end along transverse serration lines as defined in claim 3 wherein said textured surface comprises:

a cross pattern of recesses within the outer surface of said bridge member.

7. An apparatus for one handed dispensing paper sheet segments, or a paper sheet segment, from a roll of paper sheet segments connected end-to-end along transverse serration lines as defined in claim 3 wherein said textured surface comprises:

a plurality of mutually parallel recesses within the outer surface of said bridge member.

8. An apparatus for one handed dispensing paper sheet segments, or a paper sheet segment, from a roll of paper sheet segments connected end-to-end along transverse serration lines as defined in claim 3 wherein said textured surface comprises:

an elastomeric coating on the outer surface of said frictional gripping member.

9. An apparatus for one handed dispensing paper sheet segments, or a paper sheet segment, from a roll of paper sheet segments connected end-to-end along transverse serration lines as defined in claim 1 wherein:

said bridge of said frictional gripping member is pivotally connected to a support rod which in turn is pivotally connected with respect to said base.

* * * * *